United States Patent [19]

Krzywdziak et al.

[11] Patent Number: 5,020,700

[45] Date of Patent: Jun. 4, 1991

[54] LID PROVIDED WITH A VARIABLE-FLOW POURING SPOUT AND WITH AN IMPROVED VENT DEVICE, PARTICULARLY FOR CANS OF BASE COLOR FOR AUTOMOBILE COACHWORK

[76] Inventors: Alain Krzywdziak, 13 Bis Rue De La Binoche, Orleans; Daniel Parmenon, 17, rue Albert Schweitzer, Orleans La Source; Jean Godat, 35, aiiee du Houx, Olivet, all of France

[21] Appl. No.: 343,911

[22] Filed: Apr. 26, 1989

[30] Foreign Application Priority Data

Apr. 27, 1988 [FR] France ..... 88 05604

[51] Int. Cl.[5] ..... B67D 3/00

[52] U.S. Cl. ..... 222/487; 222/506; 222/561

[58] Field of Search ..... 222/487, 484, 482, 481, 222/478, 505, 506, 511, 561, 468, 148

[56] References Cited

U.S. PATENT DOCUMENTS

| | | | |
|---|---|---|---|
| 1,018,552 | 2/1912 | Cooke | 222/484 |
| 3,021,118 | 2/1962 | Dedoes | 222/561 X |
| 3,041,052 | 6/1962 | Dedoes | 222/484 |
| 4,487,342 | 12/1984 | Shy | 222/484 X |
| 4,730,753 | 3/1988 | Grime | 222/630 X |
| 4,750,648 | 6/1988 | Krydiak | 222/561 X |
| 4,793,528 | 12/1988 | Krzywdziak | 222/505 X |
| 4,838,464 | 6/1989 | Briggs | 222/481 X |

FOREIGN PATENT DOCUMENTS 2600975 1/1988 France .

*Primary Examiner*—David H. Bollinger

*Attorney, Agent, or Firm*—Scully, Scott, Murphy & Presser

[57] ABSTRACT

A lid which is provided with a variable-flow pouring spout and with an improved vent device, particularly for cans of base color for automobile coachwork. The lid includes a vent opening which is provided on an inner face thereof with a channel which leads out at a point close to the edge of the lid, substantially diametrically opposite the pouring spout.

6 Claims, 2 Drawing Sheets

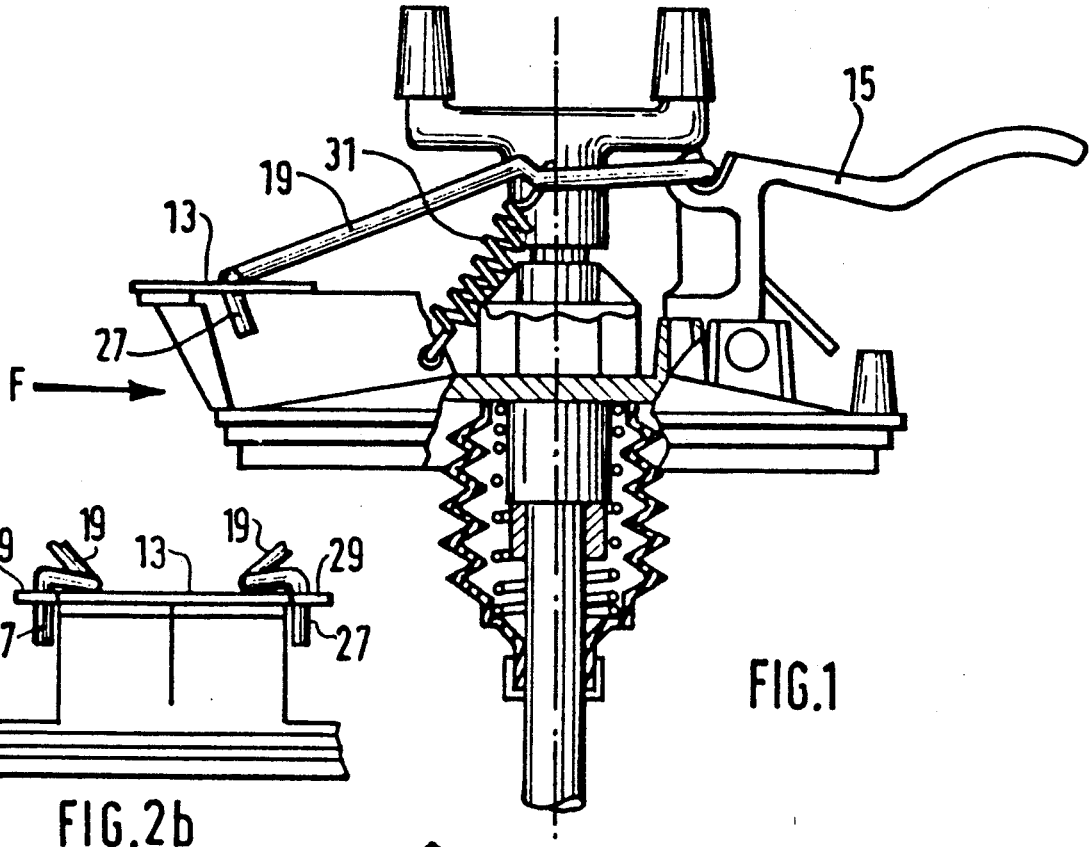
FIG.1
FIG.2b
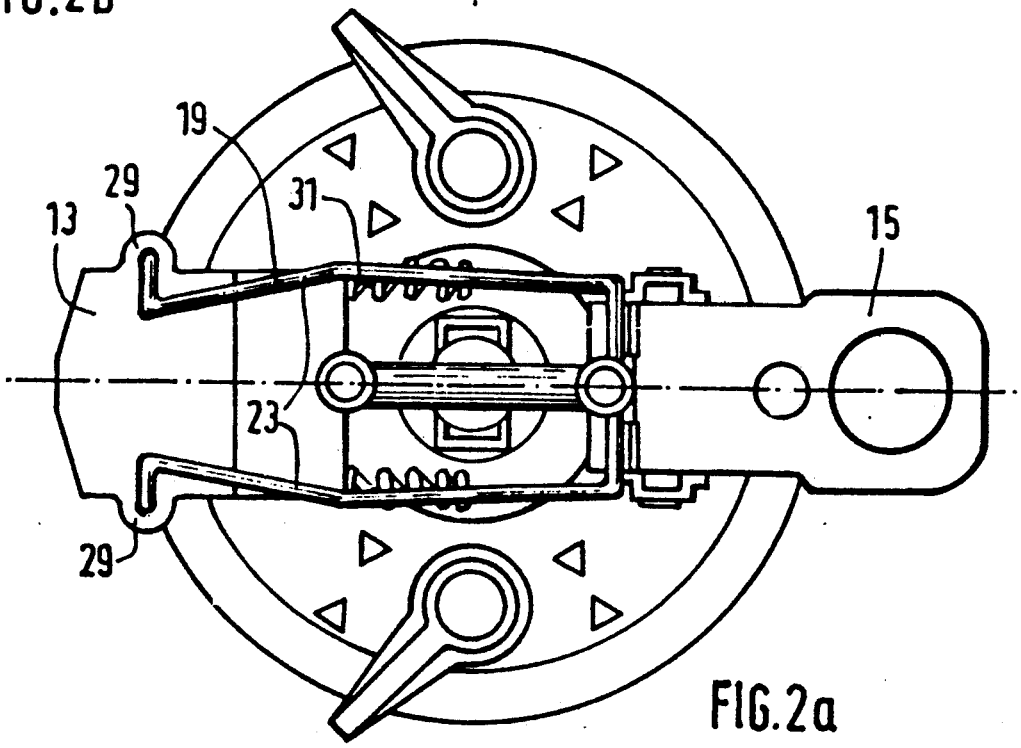
FIG.2a

LID PROVIDED WITH A VARIABLE-FLOW POURING SPOUT AND WITH AN IMPROVED VENT DEVICE, PARTICULARLY FOR CANS OF BASE COLOR FOR AUTOMOBILE COACHWORK

BACKGROUND OF THE INVENTION

1. Field of the Invention

The present invention relates to improvements made to lids for color cans, of the type described in FR-A-2 600 975.

2. Discussion of the Prior Art

It is known from the prior art to provide a lid having a pouring spout for cans of base colors in agitator machines, which comprises:

at least one member for fastening on a color can;

a pouring spout, the edge of the opening of which is strictly planar;

an operating lever pivoted at its bottom end to the top wall of the lid and movable between a position of rest and a pulled operative position;

a likewise plane slide slidable on said edge in such a manner as to close it leaktightly, and being pulled for pouring purposes by means of the operating lever, wherein the operating lever is provided on its front face, at a distance from the pouring spout, with a stop member securing said operating lever in the position of rest and bearing leaktightly against a vent opening formed in the top wall of the lid, the slide being fastened to said operating lever by a lever pivoted on the one hand at the top middle part of the slide and on the other hand to said operating lever at a distance from its pivot axis, while spring means return said slide under pressure against the opening edge of the pouring spout and return said operating lever to its position of rest, in which the opening edge of the pouring spout is closed by the slide.

This arrangement already enables the operating lever, in the position of rest, to close the vent opening of the color can, which thus becomes completely isolated from the outside atmosphere, and, in the operating position, to open this opening, by simultaneously pulling the pouring spout slide, thus permitting a regular flow of paint when the latter is poured out.

Nevertheless, since the vent opening is situated to the rear of the agitator axis, relative to the pouring spout, and relatively close to the axis, it is not possible to prevent paint from also flowing out of the vent opening when a full can of paint is sharply tipped, so that the lid is soiled and the regularity of flow of the poured paint is reduced.

SUMMARY OF THE INVENTION

The present application seeks to obviate this disadvantage and provides a lid of the type equipped with a spout for cans of base color in agitator machines, which comprises:

at least one member for fastening on a color can;

a pouring spout, the edge of the opening of which is strictly planar;

an operating lever pivoted at its bottom end to the top wall of the lid and movable between a position of rest and a pulled operative position;

a likewise planar slide slidable on said edge in such a manner as to close it leaktightly, and being pulled for pouring purposes by means of the operating lever, the latter having on its front face, at a distance from the pouring spout, a stop member securing said operating lever in the position of rest and bearing leaktightly against a vent opening formed in the top wall of the lid, the slide being fastened to said operating lever by a lever pivoted on the one hand at the top middle part of the slide and on the other hand to said operating lever at a distance from its pivot axis, while spring means return said slide under pressure against the opening edge of the pouring spout and return said operating lever to its position of rest, in which the opening edge of the pouring spout is closed by the slide, in which lid the vent opening is provided on the inner face of the lid with a channel which leads out at a point close to the edge of the lid and substantially diametrically opposite the pouring spout.

This arrangement in fact enables the air inlet to be disposed at a distance from the agitator axis or from the pouring spout, and thus prevents the aforesaid flow of paint through the vent opening in the event of the can of paint being sharply tipped.

In one advantageous practical arrangement the channel may be provided at the bottom with a movable plate leaktightly closing its bottom in the normal operating position and adapted to be moved into the open position in such a manner as to free the channel and the vertical vent opening, for example for cleaning purposes.

This channel may be composed of two parallel vertical longitudinal ribs extending radially from the vertical hole or opening substantially to the edge of the lid, these ribs being covered at their bottom edge by said plate, which closes the channel except at its end near the edge of the lid, where the hole leads out. The plate is fixed on one of the ribs by a simple screw, which permits the rotation of the plate and, for example, the complete uncovering of the channel and opening when it is turned 90° from its operating position.

The section of the plate may also be formed with internal widening in order to facilitate its centering on the ribs and to improve its retention in the operating position on the latter.

According to other advantageous characteristics of the invention, the slide will be provided with two opposite lateral rims or lugs, which are disposed substantially horizontally and through which pass vertically the respective bent-over ends of the two branches of the U-shaped rod connected to the operating lever.

The slide will thus have an essentially flat shape and will preferably have a slight thickness, for example about 0.4 millimeter, being made of steel and having a bottom coating which is antiadhesive in respect of paint.

The two bent-over ends of the rod will serve for the longitudinal translational guiding of the slide by bearing against the outer vertical wall of the spout.

The bend of the ends of each of the branches of the rod will expediently be for example so shaped that the branches will extend transversely and essentially tangentially towards the lugs, with a reentering angle in the vertical plane towards the agitator axis, in order on the one hand to ensure that the branches will bear against the slide or against said lugs through the action of the springs, and on the other hand to avoid the detachment of the bent-over ends from the lugs when the slide is pulled.

This arrangement prevents the formation of a tilting moment on the slide when it is pulled, particularly when dried paint on the bottom face of the slide offers resistance to pulling, since the rod acts directly in the plane of the slide.

Furthermore, the transmission of the resilient vertical force of the springs through the rod to the slide gives the latter excellent ability to scrape the paint off the edges of the pouring spout.

BRIEF DESCRIPTION OF THE DRAWINGS

The invention is illustrated below with the aid of a non-limiting example of a preferred embodiment and with reference to the accompanying drawings, in which:

FIG. 1 is a partial view in axial section of a lid according to the invention;

FIG. 2*a* is a top plan view of the lid;

FIG. 2*b* shows part of FIG. 1 viewed in the direction of the arrow F, showing the pivoting of the bent-over ends of the rod on the slide;

DETAILED DESCRIPTION OF THE PREFERRED EMBODIMENTS

Figure 3:
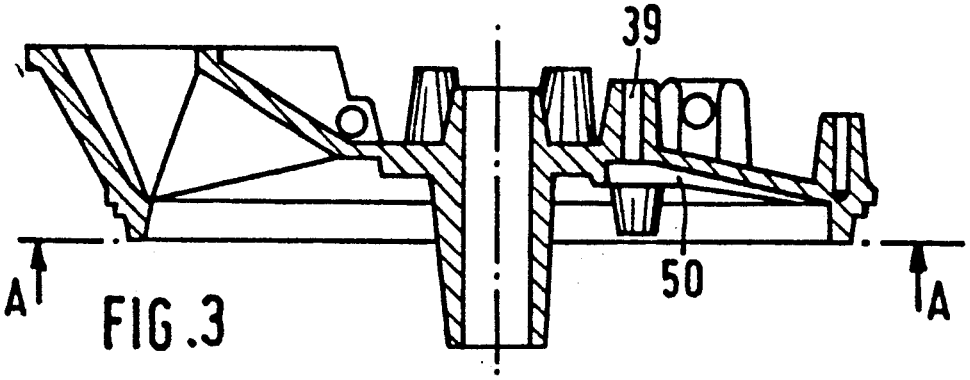
FIG. 3 shows an enlargement of FIG. 1, in which the agitator shaft and the operating components and slide components have been removed to show the vent opening more clearly.

As shown in FIGS. 1, 2*a* and 2*b*, the lid according to the invention is provided with a slide 13 whose lateral lugs or rims 29 serving as pivots for the rod 19 are substantially horizontal and disposed in the plane of the slide. The slide 13, of slight thickness (0.4 millimeter) and made of steel with an antiadhesive coating on its bottom face, is thus perfectly planar. The bent-over ends 27 of each of the opposite branches 23 of the rod 19 are received in said lugs in two vertical planes. These ends 27 are bent over horizontally to extend transversely (relative to the axis of movement of the slide) towards the slide and to bear against the slide, and in the vertical plane at an angle of 90° relative to the plane of the rod, this angle thus being reentrant towards the interior of the lid.

When this is done, because of the slight inclination of the branches in relation to the plane of the slide, the vertical component of the force of the springs 31, applied to the rod, is perfectly transmitted to the slide. This ensures that paint deposited on the edge of the lid will be very effectively scraped off. In addition, the angle of bend, in the vertical plane, of the ends 27 of the branches of the rod being reentrant towards the interior, there is no risk of the detachment of these ends from their lugs during the operation of pulling the slide by means of the operating lever 15. Furthermore, as the ends 27 act directly on the lugs in the plane of the slide, practically no tilting moment is produced on the latter when it is pulled by the operating lever in the event of dried paint offering resistance to the movement of the slide.

Figure 6:
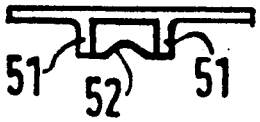
FIG. 6 is an enlarged schematic view of the section of the vent opening channel.
Figure 4:
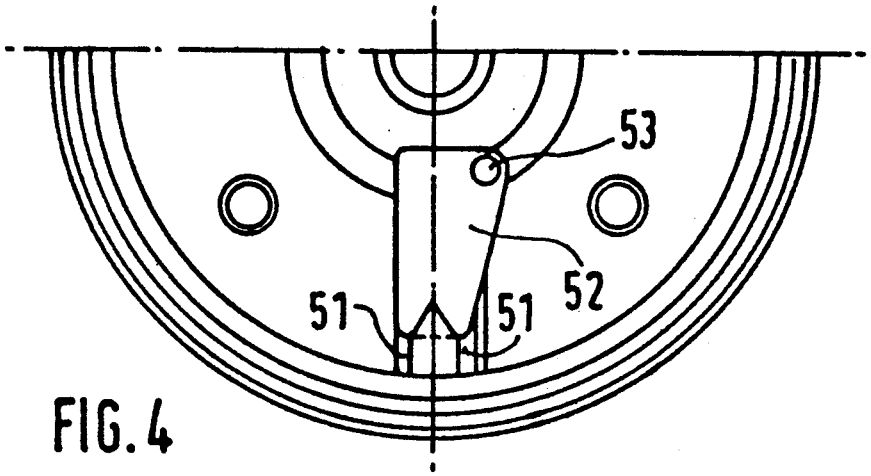
FIG. 4 shows a half-section taken on the line A—A in FIG. 3, showing in particular the channel of the vent opening with its bottom plate.

In FIG. 3, there can be seen the vent opening 39 in the lid, extended radially by its channel 50 bringing the air hole to a point close to the edge of the lid. This channel, situated inside the lid, consists of two parallel vertical ribs 51 (FIG. 6) fastened to the inside face of the lid, and of a closure plate 52 fixed by a screw 53 to one of the ribs. The ribs extend radially oppositely to the pouring spout, from the vent opening 39 to a point close to the edge of the lid (where the air hole leads out) and are leaktightly closed by the plate at their bottom edge (FIG. 4). The channel is thus closed from the vertical vent opening to its outer radial edge where the air hole leads out. It can thus clearly be seen that the air inlet has been moved away from the pouring spout and that the risk of paint flowing through the vent opening is considerably reduced in comparison with the previous arrangement, in which air entered solely through the vertical vent opening.

Figure 5:
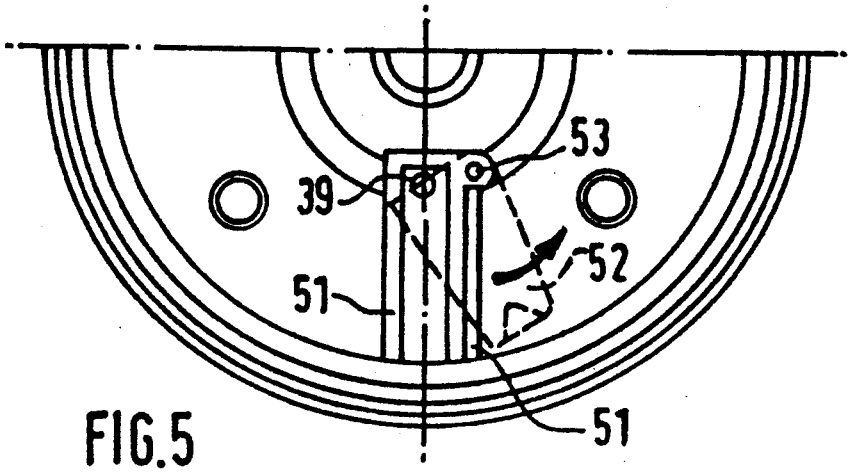
FIG. 5 is a similar view to FIG. 4, showing the plate in the open position.

The plate 52 is rotatable (FIG. 5) about the screw 53, from its closed or operating position (FIG. 4) to an open position at 90° from said closed position, the vertical vent opening and the channel then being uncovered. This open position of the plate allows the channel and the vertical vent opening in the lid to be cleaned from time to time.

Furthermore, the plate is shaped with an internal widening facilitating its closing or centering on the ribs and holding it stably in the operating position.

The present invention therefore provides an advantageous development in comparison with known pouring lids, particularly with regard to the risk of paint flowing through the vent opening.

We claim:

1. A lid for cans of base color in agitator machines, which comprises:

at least one member for fastening on a color can, a pouring spout provided with an opening having an edge which is strictly planar, an operating lever pivoted at a bottom end thereof to a top wall of the lid and movable between a position of rest and a pulled operative position, a likewise planar slide slidable on said edge in such a manner as to close it leaktightly, and being pulled for pouring purposes by means of the operating lever, the operating lever having on a front face thereof, at a distance from the pouring spout, a stop member securing said operating lever in the position of rest and bearing leaktightly against a vent opening formed in the top wall of the lid, the slide being fastened to said operating lever by a lever pivoted on the one hand at a top middle part of the slide and on a pivot axis of said operating lever, while spring means return said slide under pressure against the edge of the pouring spout and return said operating lever to its position of rest, in which the edge of the pouring spout is closed by the slide, in which lid the vent opening is provided on an inner face of the lid with a channel which leads out at a point close to the edge of the lid and substantially diametrically opposite the pouring spout, said slide being provided with two opposite lateral rims or lugs which are disposed in the plane of the slide and through which there vertically pass respective bent-over pivoting ends of two branches of a U-shaped rod connected to the operating lever.

2. A lid as claimed in claim 1, wherein the slide is of slight thickness, of approximately 0.4 millimeter, and is made of steel with an anti-adhesive coating on one side forming an inside face thereof.

3. A slide as claimed in claim 1, wherein the bend of said bent-over ends is suitably shaped, the branches extending substantially tangentially and transversely towards the lugs and bearing against the slide, and with a reentering angle in a vertical plane towards an axis of the agitator machine, in such a manner as to ensure, on the one hand, that the branches will bear against said lugs through the action of springs, and on the other hand to avoid the detachment of the ends from the lugs when the slide is pulled.

4. A lid for cans of base color in agitator machines, which comprises:

at least one member for fastening on a color can, a pouring spout provided with an opening having an edge which is strictly planar, an operating lever pivoted at a bottom end thereof to a top wall of the lid and movable between a position of rest and a pulled operative position, a likewise planar slide slidable on said edge in such a manner as to close it leaktightly, and being pulled for pouring purposes by means of the operating lever, the operating lever having on a front face thereof, at a distance from the pouring spout, a stop member securing said operating lever in the position of rest and bearing leaktightly against a vent opening formed in the top wall of the lid, the slide being fastened to said operating lever by a lever pivoted on the one hand at a top middle part of the slide and on a pivot axis of said operating lever, while spring means returns said slide under pressure against the edge of the pouring spout and return said operating lever to its position of rest, in which the edge of the pouring spout is closed by the slide, in which lid the vent opening is provided on an inner face of the lid with a channel which leads out at a point close to the edge of the lid and substantially diametrically opposite the pouring spout, said channel has provided at a bottom thereof a movable plate leaktightly closing said bottom in the operating position and adapted to be moved into an open position in such a manner as to free the channel and the vertical vent opening for cleaning, said plate being fixed on one of the ribs by a screw which permits the rotation of the plate up to 90° from its operating position, in order to free the channel and the vertical vent opening for cleaning purposes.

5. A lid as claimed in claim 4, wherein said plate is formed with an internally widening portion in order to facilitate centering of said plate in the operating position on the ribs and to improve retention of said plate in the operating position.

6. A lid as claimed in claim 4, wherein said channel is composed of two parallel vertical longitudinal ribs extending radially oppositely to the pouring spout, from the vertical vent opening substantially to an edge of the lid, these ribs being covered at their bottom edge by said plate, which closes the channel except at its end near the edge of the lid, where the vent opening leads out.

* * * * *